US009428897B2

(12) United States Patent
Le et al.

(10) Patent No.: US 9,428,897 B2
(45) Date of Patent: Aug. 30, 2016

(54) TOUCHLESS ACTIVATION OF A TOILET

(71) Applicant: FLUIDMASTER, INC., San Juan Capistrano, CA (US)

(72) Inventors: Tuan Le, Fountain Valley, CA (US); Adam Sampson, Ramona, CA (US); Derres Catalano, Solana Beach, CA (US); Stewart Walton, Encinitas, CA (US); Scott Valoff, San Diego, CA (US); Robb Milley, Vista, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 376 days.

(21) Appl. No.: 14/108,144

(22) Filed: Dec. 16, 2013

(65) Prior Publication Data

US 2015/0167280 A1 Jun. 18, 2015
US 2016/0168835 A9 Jun. 16, 2016

Related U.S. Application Data

(60) Provisional application No. 61/738,210, filed on Dec. 17, 2012.

(51) Int. Cl.
*E03D 1/00* (2006.01)
*E03D 5/10* (2006.01)
*E03C 1/05* (2006.01)

(52) U.S. Cl.
CPC ..... *E03D 5/105* (2013.01); *E03C 1/057* (2013.01)

(58) Field of Classification Search
CPC ..... E03D 5/105
USPC ..... 4/300–442
See application file for complete search history.

(56) References Cited

U.S. PATENT DOCUMENTS 3,471,868 A 10/1969 Zorn
4,141,091 A * 2/1979 Pulvari ..... E03D 5/105 361/179
8,556,228 B2 * 10/2013 Marcichow ..... E03D 3/02 251/129.04
8,695,125 B2 * 4/2014 Funari ..... E03D 5/105 251/129.04

(Continued)

FOREIGN PATENT DOCUMENTS

CA 2557704 A1 2/2008
EP 1057942 A2 12/2000
WO WO0246541 A1 6/2002

OTHER PUBLICATIONS

International Searching Authority, International Search Report for International Application No. PCT/US2013/075482, mailed Apr. 4, 2014, 2 pages.

(Continued)

*Primary Examiner* — Lori Baker
(74) *Attorney, Agent, or Firm* — Gordon Rees Scully Mansukhani LLP

(57) ABSTRACT

A toilet sensor and actuator assembly, having: (a) an infrared sensor configured to detect the presence of an object at a far distance from a toilet; (b) an ultrasonic sensor configured to detect the presence of the object at a near distance from the toilet, wherein the ultrasonic sensor remains in a sleep mode until awakened by a signal from the infrared sensor that the infrared sensor has detected the presence of the object at the far distance; and (c) an actuator mechanism that flushes the toilet in response to a signal from the ultrasonic sensor that the ultrasonic sensor has detected the presence of the object at the near distance.

15 Claims, 3 Drawing Sheets

(56) References Cited

U.S. PATENT DOCUMENTS

| | | | | |
|---|---|---|---|---|
| 9,169,626 | B2 * | 10/2015 | Guler | E03D 3/06 |
| 2005/0246828 | A1 * | 11/2005 | Shirai | E03D 9/08 4/420.4 |
| 2007/0199952 | A1 * | 8/2007 | Carpenter | A61L 9/14 222/52 |
| 2008/0271231 | A1 * | 11/2008 | Stauber | A47K 13/305 4/246.1 |
| 2008/0276408 | A1 * | 11/2008 | Gilbert, Jr. | A47L 11/34 15/320 |
| 2009/0160659 | A1 | 6/2009 | Bailey | |
| 2009/0241248 | A1 * | 10/2009 | Vollmar | E03D 5/105 4/313 |
| 2010/0252759 | A1 * | 10/2010 | Guler | E03D 5/105 251/129.04 |
| 2011/0017930 | A1 | 1/2011 | Marcichow et al. | |
| 2012/0235578 | A1 * | 9/2012 | Miller | H05B 37/0227 315/152 |
| 2012/0287031 | A1 | 11/2012 | Valko et al. | |

OTHER PUBLICATIONS

International Searching Authority, Written Opinion for International Application No. PCT/US2013/075482, mailed Apr. 4, 2014, 5 pages.

International Preliminary Examining Authority, International Preliminary Report on Patentability for International Application No. PCT/US2013/075482, mailed Dec. 5, 2014, 21 pages.

European Patent Office, Extended European Search Report for European Application No. 13865770.5, mailed Nov. 30, 2015, 13 pages.

* cited by examiner

TOUCHLESS ACTIVATION OF A TOILET

RELATED APPLICATION

The present invention claims priority to U.S. Provisional Patent Application 61/738,210, entitled "Touchless Activation of A Flush Toilet", filed Dec. 17, 2012, the entire disclosure of which is incorporated by reference in its entirety.

TECHNICAL FIELD

The present invention relates to systems that cause a toilet to flush without a user having to touch the toilet, or touch objects mounted on the toilet.

BACKGROUND OF THE INVENTION

Many sensor systems currently exist for causing toilets or urinals to flush when a user moves away from them. In addition, sensor systems currently exist to cause faucets to turn on when a user's hands move towards them. However, the biggest problem with these sensors is that they use infrared sensing.

Infrared sensing has many drawbacks. For example, infrared sensing is affected by ambient light levels, the color or surface texture of the object that reflects the light, and even the room temperature. In fact, a user's shadow cast inadvertently over the sensor can cause it to function at the wrong time, or not function at all.

Any of these above factors can affect the timing of the actuator triggering, and whether or not the actuator even triggers. As any person who has used public bathrooms can attest, the automatic flushing of the toilet or the automatic turning on of the faucet at the counter can be unpredictable. All too often, the toilet flushes too quickly or not at all, and the user is later waving their soapy hands under the faucet in an attempt to turn it on.

What is instead desired is an activation sensor system that is reliable and is not affected by changes in ambient light, reflecting surface colors or textures or inadvertent shadows being cast over the sensor. It is also desirable that such system be cost effective such that it can be incorporated into residential toilet designs when a "touchless" flushing would be desired. As will be explained, the present invention provides such a solution.

SUMMARY OF THE INVENTION

The present invention provides a system that uses an ultrasonic sensor to trigger the flushing of a toilet (or activation of some other device or appliance). The advantages of using an ultrasonic sensor (to preferably detect the presence of a user's hand close to a sensor) include the fact that ultrasound is not affected by ambient light levels. In addition, ultrasound is not affected by the color of the user's clothing that it reflects off of; nor is it affected by the surface texture of the user's clothing. Ultrasonic sensors are also less sensitive to temperature variations temperature. Yet another advantage of ultrasonic sensors in general is that they don't require optical lenses.

The present ultrasonic sensor is preferably configured to detect an object. An advantage of ultrasonic detection (as compared to infrared detection) is that ultrasonic detection can offer distance detection. Therefore, ultrasonic detection can be used to determine the distance of the object where the infrared sensing is used to detect the presence of the object.

The present system can therefore be calibrated such that a static (i.e.: non-moving) object in the sensing field (such as a shower curtain or cabinet) does not trigger the flush activation. In one optional preferred embodiment, the ultrasonic sensor is configured to detect objects at a near distance (while the infrared sensor will detect the object at a far distance). As such, the toilet only flushes when the user's hand is positioned quite close to the sensor switch on the side of the toilet. The more precise the sensing range and sensitivity of the detection method, the more accurate the activation signal will be. Therefore, the toilet will flush only when desired. Moreover, another advantage of using an ultrasonic sensor is that it allows for "ranging" (i.e.: determining the distance from an object to the sensor). An ultrasonic sensor can therefore reliably determine whether the object is close or far from the toilet which may be useful if the sensor is to trigger different actions at different times depending on the location or movement of the user. Moreover, the ultrasonic detection (as compared to infrared detection) will advantageously be affected less by color or texture variations. This also improves system reliability.

Unfortunately, the only disadvantage with using an ultrasonic sensor (as compared to infrared sensors) is relatively higher power consumption. Specifically, if an ultrasonic sensor is battery powered, it may require the user to change batteries too frequently. The alternative to using battery power would be for the sensor system to be connected to a bathroom AC outlet. Unfortunately, many users would not opt for a toilet that has to be plugged into a wall power supply in their private residence.

Therefore, the present invention also provides a novel system of power conservation for the ultrasonic sensor. In brief, this system comprises using an infrared sensor in combination with an ultrasonic sensor wherein the ultrasonic sensor remains primarily in a (power conserving) "sleep mode" and is only awakened by the infrared sensor when the infrared sensor detects a user at a distance (for example, when the user enters the bathroom). In preferred embodiments, the infrared sensor is a "passive infrared sensor". Such a passive infrared sensor offers the advantage of low power detection of thermal gradients (e.g.: a person or a hand), but do not offer proximity or distance information. Therefore, the present invention couples infrared sensing with the ultrasonic sensing system. Since the infrared sensor uses far less power than the ultrasonic sensor, the resulting system requires far less power than using an "always on" ultrasonic sensor. This both extends system battery life, and improves system performance (i.e.: thereby accurately triggering the flushing at the proper times). Moreover, the infrared sensor is ideally suited to detect a person's body or a person's hand since the infrared sensor will be detecting the heat given off by the person's body. Thus, the infrared sensor can first detect the presence of the user (by viewing a thermal gradient), with the awakened ultrasonic sensor then detecting the person's body or a person's hand at a close distance.

In preferred embodiments, the present invention provides a sensor and actuator assembly, comprising: (a) an infrared sensor configured to detect the presence of an object; (b) an ultrasonic sensor configured to detect the presence of the object, wherein the ultrasonic sensor remains in a sleep mode until awakened by a signal from the infrared sensor after the infrared sensor has first detected the presence of the object; and (c) an actuator mechanism that activates in response to a signal from the ultrasonic sensor that the ultrasonic sensor has detected the presence of the object. Preferably, the infrared sensor is configured to detect the presence of the object at a far distance and the ultrasonic sensor is configured to detect the presence of the object at a near distance.

DETAILED DESCRIPTION OF THE DRAWINGS

Figure 1:
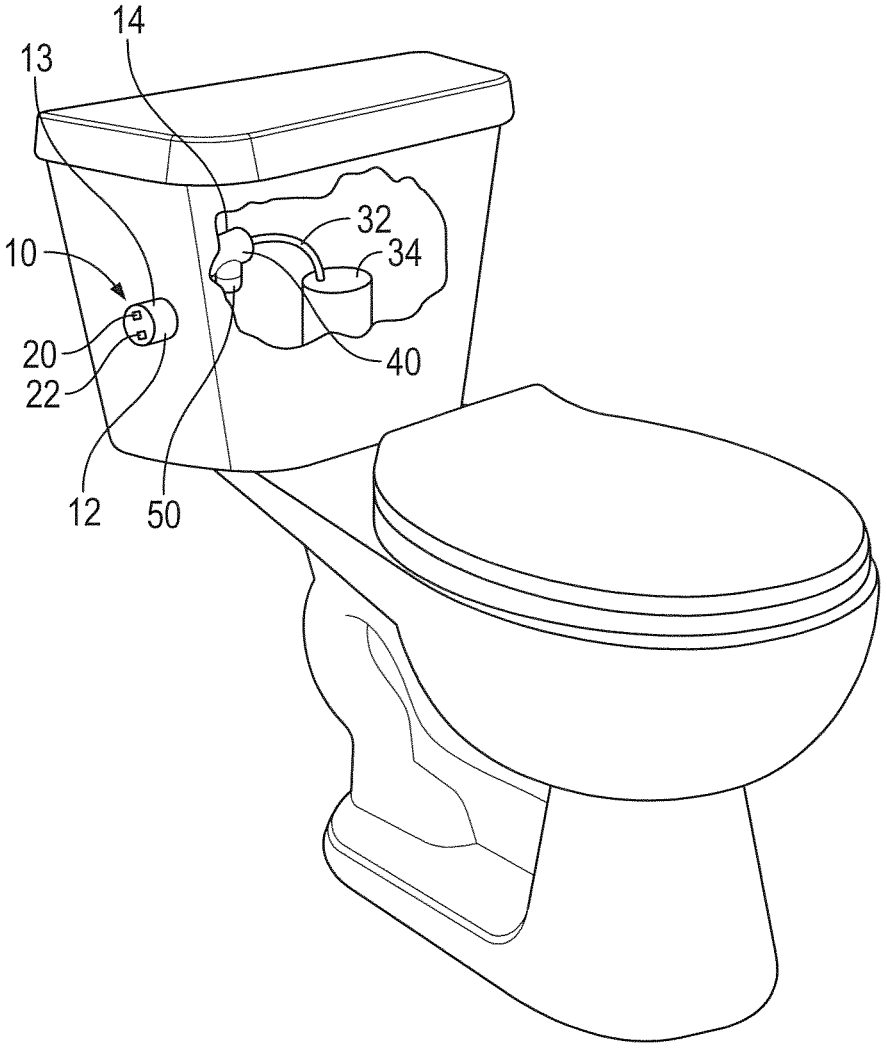
FIG. 1 is a cutaway perspective view of a toilet with the present flushing sensor and actuator assembly mounted thereon.

FIG. 1 illustrates the placement of the present invention on a toilet. As will be explained, the present invention ideally provides a system for detecting the presence of a user's hand near a sensor to cause the toilet to flush. It is to be understood, however, that the present invention is not limited to systems for flushing toilets. For example, the present invention can also be used for flushing urinals, or for turning on a faucet at a sink counter. In fact, the present invention can even be used to activate, or turn on, any device or appliance, including but not limited to, bathroom and kitchen devices and appliances. The advantage of the present invention is that it provides "touchless" operation for the user. In other words, the user need not touch the toilet or any device mounted on the toilet to cause the toilet to flush. This, of course, improves hygiene, and is desirable both in public bathrooms and in in private residences. (Note: FIG. 1 is a cut away view also showing internal components of the toilet, to illustrate flushing operation).

Figure 2:
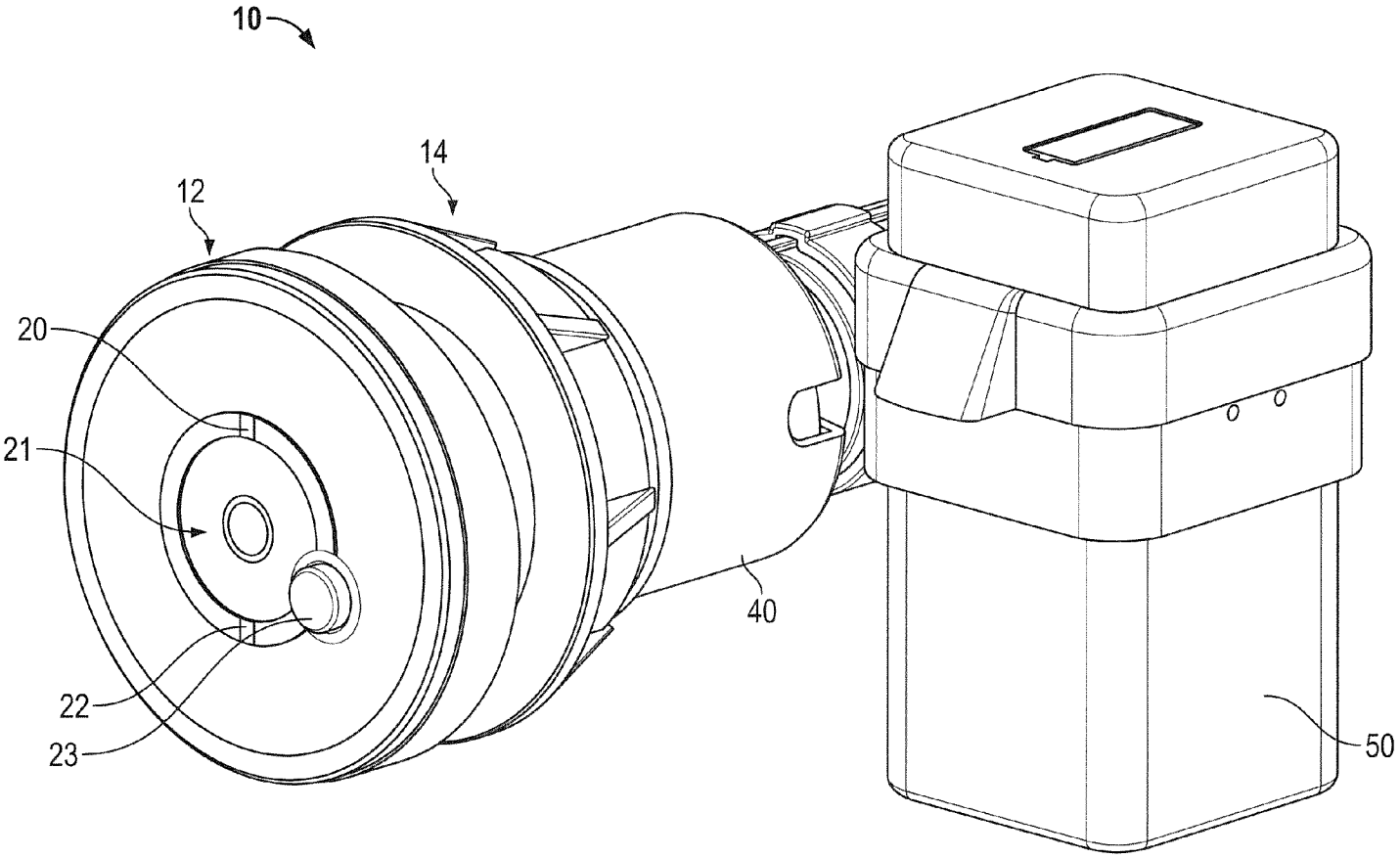
FIG. 2 is a close up front perspective view of the sensor and actuator assembly.
Figure 3:
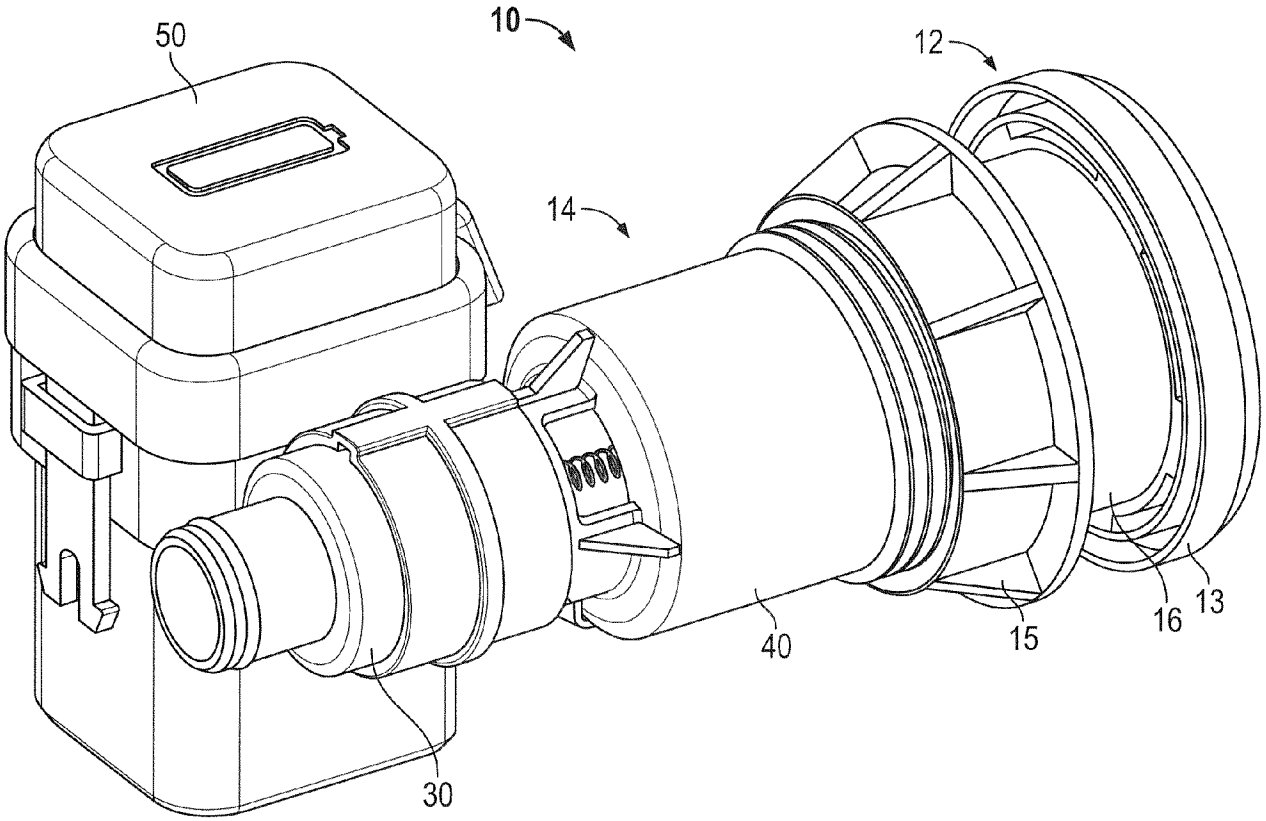
FIG. 3 is a close up rear perspective view of the sensor and actuator assembly.

FIGS. 2 and 3 show close up perspective views of assembly 10. Assembly 10 is received through a hole in the side of the toilet tank. Assembly 10 comprises a housing having an outer portion 12 disposed to protrude out of the side of the toilet tank wall, and an inner portion 14 disposed within the toilet tank. A screw cap 15 (positioned within the tank) can be rotated to tighten assembly 10 into the hole in the toilet tank. As such, the tank wall becomes sandwiched between screw cap 15 and the large radius flange 13 on outer portion 12. Mid-portion 16 is dimensioned to fit snuggly in the hole passing through the tank wall. Thus, the radius of portion 16 is only very slightly smaller than the radius of the hole itself.

Sensor and actuator assembly 10 comprises an infrared sensor 20 and an ultrasound sensor 22. It is to be understood that an "ultrasound sensor" as described herein preferably comprises an ultrasound transducer, being a membrane that is excited and resonates. This membrane receives sound energy and thus creates a voltage potential based on the amplitude of the sound pressure. Pushing pad 21 is a manual on/off switch that turns the entire system on and off. In addition, a manual flush activation button 23 is also provided (for example in the event of a power failure).

Infrared sensor 20 is configured to detect the presence of an object, and is used to "wake up" ultrasonic sensor 22. During normal operation, ultrasonic sensor 22 is in a "sleep mode" such that system power consumption is significantly reduced. When a user enters the room, or moves close to the toilet, the infrared sensor 20 will detect the presence of the user. At this time, the infrared sensor 20 will then turn on ultrasonic sensor 22, thereby awakening it from its sleep. Finally, when the user's hand is positioned close to the ultrasonic sensor 22 itself, a signal will be sent to an actuator mechanism that will trigger toilet flushing. In this way, the user's hand need only be positioned a few inches from the outer portion 12 of assembly 10 to cause the toilet to flush. The benefit of using an ultrasonic sensor at these close distances (as opposed to a standard infrared sensor, if an object is too close to the infrared sensor, then a user's hand may shade the sensor causing it to fail to detect the increase in reflected light.

In one optional embodiment, the actuator mechanism 30 will cause a solenoid (not shown) to move an internal plunger to move air through a pneumatic cable (or simply push or pull a physical cable), designated herein as element 32. The movement of, or through, element 32 can be used to cause flush valve 34 to flush the toilet. It is to be understood that the structure of elements 32 and 34 is not limited to any particular embodiment or device. One example of a suitable activation mechanism (i.e.: a system comprising elements 32 and 34) is found in U.S. patent application Ser. No. 13/943,991, entitled "Toilet Discharge Valve Assembly Having Moveable Buoyant Float Therein", filed Jul. 17, 2013, the entire disclosure of which is incorporated herein by reference in its entirety. The system disclosed in that patent application uses a switch (labeled as element #42) to selectively open and close an air passageway to permit a buoyant float (covering a discharge valve) to lift and thereby flush the toilet. Any other device (including but not limited to a lever arm) may be part of actuator mechanism 30.

Again, it is to be understood that the above flush valve 34 example is not limiting. Any suitable actuation mechanism may instead be used in accordance with the present invention. Moreover, actuator mechanism 30 could be an electrical actuator that turns on a power switch, a hydraulic actuator that turns on a faucet tap, or more generally, any actuation mechanism that activates any appliance or device. Different actuator mechanisms can be used such that the present invention can be tailored to the use of many different products.

In preferred embodiments, infrared sensor 20 detects the presence of the object at a far distance and ultrasonic sensor 22 detects the presence of the object at a near distance. The far distance can be up to ten or more feet, but could also be shorter distances like 0 to 24 inches, or even just 0 to 15 inches. It is to be understood that the present invention is not limited to any specific "far distance". In various preferred embodiments, the near distance is preferably less than 8 inches. Most preferably, the near distance is less than 3 inches. The advantage of this configuration is that a reliable ultrasonic sensor system is used to detect the user's hand when the user's hand is within a few inches from assembly 10. The advantage is that ultrasound detection is much more reliable than simple infrared detection (as was explained above). However, by relying on the infrared sensor to first detect the user entering the room, and then turn on ultrasonic sensor 22, assembly 10 conserves the power required to operate ultrasonic sensor 22. Moreover, the actuator mechanism 30 only activates after both the infrared sensor 20 and the ultrasonic sensor 22 have both detected the object. This further increases the reliability of the system.

In preferred aspects, actuator mechanism 30 comprises: a solenoid; a plunger rod in the solenoid, the plunger rod being moved by electric current passing through the solenoid; and a pneumatic tube or a connecting cable 32. Movement of the plunger rod causes air to move in the pneumatic tube or wherein movement of the plunger rod moves the connecting cable, and wherein the movement of air in the pneumatic tube or the movement of the connecting cable causes flush valve 34 to cause the toilet to flush. Assembly 10 preferably comprises a housing 40, wherein the infrared sensor 20, the ultrasonic sensor 22 and the solenoid (not shown) are all disposed within (or on) the housing.

In preferred embodiments, assembly 10 further comprises a battery power supply canister 50 that supplies the power to both infrared sensor 20 and ultrasonic sensor 22. Optionally, the battery canister 50 can be connected to housing 40 such that the battery canister 50 is also disposed within toilet tank. It is be understood, however, that the batteries can instead be disposed within the same physical housing as the infrared and ultrasonic sensors.

In preferred embodiments, assembly 10 further comprises a microcontroller (not shown) disposed within housing 40. The microcontroller receives the signal from infrared sensor 20 that the object has been detected and then sends a signal to the ultrasonic sensor 22 to awaken the ultrasonic sensor from its sleep mode.

In some optional preferred embodiments, the present invention simply provides an ultrasonic sensor 22 configured to detect the presence of an object; and a flush actuator mechanism 30 that flushes a toilet in response to a signal from the ultrasonic sensor when the ultrasonic sensor detects the presence of the object. (In these embodiments, the infrared sensor is omitted, and the ultrasonic sensor remains on. These embodiments may be appropriate if the power drain on the battery pack is low enough or the power supply is high enough such that the ultrasonic sensor 22 can be left on at all times).

The present invention also provides a method of actuating a device by:

(a) detecting the presence of an object using infrared sensor 20 mounted on the device; (b) awaking an ultrasonic sensor 22 from a sleep mode after the infrared sensor 20 has detected the presence of the object, wherein ultrasonic sensor 22 is also mounted on the device; (c) detecting the presence of the object with ultrasonic sensor 22; and (d) activating an actuator mechanism 30 in response to the ultrasonic sensor detecting the presence of the object.

What is claimed is:

1. A sensor and actuator assembly, comprising:

an infrared sensor configured to detect the presence of a user at a far distance;

an ultrasonic sensor configured to detect the presence of the user at a near distance, wherein the ultrasonic sensor remains in a sleep mode until awakened by a signal from the infrared sensor after the infrared sensor has first detected the presence of the user at the far distance; and an actuator mechanism that activates in response to a signal from the ultrasonic sensor that the ultrasonic sensor has detected the presence of the user.

2. The sensor and actuator assembly of claim 1, wherein the near distance is less than 8 inches.

3. The sensor and actuator assembly of claim 2, wherein the near distance is less than 3 inches.

4. The sensor and actuator assembly of claim 1, wherein the actuator is a toilet flush actuator.

5. The sensor and actuator assembly of claim 1, wherein the actuator is a faucet activation actuator.

6. The sensor and actuator assembly of claim 1, wherein the actuator is an appliance activation actuator.

7. A sensor and actuator assembly for causing a toilet to flush, comprising:

an infrared sensor configured to detect the presence of a user;

an ultrasonic sensor configured to detect the presence of the user; and an actuator mechanism that activates in response to a signal from the ultrasonic sensor that the ultrasonic sensor has detected the presence of the user, wherein the actuator mechanism comprises:

a solenoid;

a plunger rod in the solenoid, the plunger rod being moved by electric current passing through the solenoid; and a pneumatic tube or a connecting cable, wherein movement of the plunger rod causes air to move in the pneumatic tube or wherein movement of the plunger rod moves the connecting cable, and wherein the movement of air in the pneumatic tube or the movement of the connecting cable causes the toilet to flush.

8. The sensor and actuator assembly of claim 7, further comprising:

a housing, wherein the infrared sensor, the ultrasonic sensor and the solenoid are all disposed within the housing.

9. The sensor and actuator assembly of claim 8, wherein the housing passes through a toilet tank wall.

10. The sensor and actuator assembly of claim 8, wherein the assembly further comprises:

a battery power supply that supplies power to the infrared sensor and the ultrasonic sensor.

11. The sensor and actuator assembly of claim 10, further comprising:

a battery canister, wherein the battery canister is connected to the housing and the battery canister is disposed within a toilet tank.

12. A method of actuating a device comprising:

detecting the presence of a user at a far distance using an infrared sensor;

detecting the presence of the user at a near distance with the ultrasonic sensor, wherein the ultrasonic sensor remains in a sleep mode until awakened by a signal from the infrared sensor after the infrared sensor has first detected the presence of the user at the far distance; and activating an actuator mechanism in response to the ultrasonic sensor detecting the presence of the user.

13. The method of claim 12, the actuator mechanism flushes a toilet.

14. The sensor and actuator assembly of claim 1, wherein the far distance is up to 10 feet.

15. The sensor and actuator assembly of claim 1, wherein the far distance is up to 24 inches.

* * * * *